US007077909B1

(12) United States Patent
Crane

(10) Patent No.: US 7,077,909 B1
(45) Date of Patent: Jul. 18, 2006

(54) DOORKNOB PAINT SHIELD

(76) Inventor: Richie L. Crane, 11420 Pine Lilly Pl., Bradenton, FL (US) 34237

( * ) Notice: Subject to any disclaimer, the term of this patent is extended or adjusted under 35 U.S.C. 154(b) by 0 days.

(21) Appl. No.: 10/973,227

(22) Filed: Oct. 26, 2004

(51) Int. Cl.
*B05C 21/00* (2006.01)

(52) U.S. Cl. ..... 118/500; 118/503; 118/504; 118/505

(58) Field of Classification Search ..... 118/500, 118/503, 504, 505; 427/282; 70/424, 428, 70/DIG. 58, 211, 158
See application file for complete search history.

(56) References Cited

U.S. PATENT DOCUMENTS

| | | | | |
|---|---|---|---|---|
| 2,925,064 A | | 2/1960 | Kahn | |
| 3,174,788 A | * | 3/1965 | Williams | 292/347 |
| 3,722,470 A | | 3/1973 | Farrell | |
| 4,327,663 A | | 5/1982 | Izzo | |
| 4,656,058 A | | 4/1987 | Stark | |
| 4,695,486 A | | 9/1987 | Stark | |
| 4,921,028 A | | 5/1990 | Schwartz | |
| 5,008,551 A | | 4/1991 | Randolph | |
| 5,840,122 A | | 11/1998 | Williams | |
| 6,165,269 A | * | 12/2000 | Kathe | 118/505 |

* cited by examiner

*Primary Examiner*—Laura Edwards
(74) *Attorney, Agent, or Firm*—Charles J. Prescott

(57) ABSTRACT

A paint shield device for doorknobs of various sizes. The device includes two flexible clamshell shaped half cups mold formed together as a unit and connected together along a living hinge between the half cups. The half cups are pivotally movable together about the living hinge to mate or overlap each free distal side margin of each of the half cups to form a substantially complete cup having a substantially cylindrical side wall, a substantially closed bottom, and an open end adapted to admit a doorknob therein. A prong or post extends outwardly from an outer sidewall surface of each half cup to receive an elastic connector stretchably attachable to each prong or post with the half cups in the closed position to produce sufficient biasing force to hold the device in position over the doorknob.

2 Claims, 5 Drawing Sheets

DOORKNOB PAINT SHIELD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to painters' utensils and hardware, and more particularly to a device which protects generally circular doorknobs and doorknobs with circular mounting bases and laterally extending handles from becoming painted, stained or varnished when such materials are being applied to adjacent door and room surfaces.

2. Description of Related Art

During the painting and decorative covering of the interior of a building with any of a broad range of spreadable coating materials such as paints, varnishes, lacquers, stain and the like, there is considerable risk of inadvertently getting such spreadable materials onto the hardware within a room. One particular area of concern is the doorknobs which are quite susceptible to paint droppings, splashes and inadvertent paint applicator strokes bumping there against. One typical means for preventing paint and the like from getting onto the door hardware would be simply to mask it off in its entirety which is a tedious and time consuming process both to apply and to remove after painting.

However, a number of prior art devices are intended to facilitate protecting the doorknobs in various fashions. An early doorknob paint shield is disclosed in U.S. Pat. No. 2,925,064 invented by Kahn which teaches two semi-cylindrical members pivotally connected together at a common end thereof and held in place around a cylindrical or circular base of a doorknob by magnetic strips attached to the distal edges of the semi-circular members.

Stark, in U.S. Pat. No. 4,695,486 teaches another paint shield formed of an arcuately configured length of material having a biased spiral wind which, when expanded and then allowed to biasingly contract around the base of the doorknob, remains in self-supporting position to protect the doorknob from becoming paint spattered.

In U.S. Pat. No. 6,165,269, Kathe teaches hardware paint protectors for virtually all of the hardware within a room not intended to become painted. In FIG. 4 therein, a tapered cup arrangement is slidably engageable over the doorknob, and separately the tumbler lock, to effect protection of these hardware members attached to the door.

In U.S. Pat. No. 4,656,058, Stark teaches another self-supporting paint shield for doorknobs having a continuous angular wall portion defining an opening for receiving the doorknob. The annular wall portion has a tapered rim of the open end defining a diameter which is different from that of the doorknob for enhanced gripability and limited interference with paint being applied directly up to the base of the doorknob.

In U.S. Pat. No. 5,008,551, Randolph teaches a phosphorescent luminous doorknob cover which is primarily decorative in nature, while Schwartz, in U.S. Pat. No. 4,921,028 teaches a door hardware cover which is formed to become a sealable plastic bag around the doorknob held in place by adhesive strips.

Izzo in U.S. Pat. No. 4,327,663 teaches a doorknob shield having an elongated longitudinally extending handle attached to a truncated conical shaped skirt. The skirt is sized at an open end thereof to be positioned over the doorknob abutting against the door immediately adjacent to the doorknob itself. A doorknob cover in U.S. Pat. No. 5,840,122 invented by Williams teaches another form of cover for enclosing a doorknob during painting of the door having a spherical resilient knob cover assembly which is positionable over a similarly configured doorknob. An escutcheon cover assembly covers the similarly shaped escutcheon and shaft of the doorknob.

Farrell teaches a protecting shield in U.S. Pat. No. 3,722,470 formed of two sheets of cardboard secured along their side edges so that they may be bowed outwardly from one another and held in this position by bottom panels which fold inwardly to maintain this three dimensional structure for engagement over a doorknob.

The present invention teaches a doorknob paint shield which is formed as a unit of molded thin wall flexible plastic material and is easily adapted to fit over and be secured onto a broad range of diameters of doorknobs. This omni-sized feature is facilitated by the flexibility of half cup-shaped members hingedly connected along a common longitudinal margin thereof which, when folded together may be held in abutting edge to edge fashion or overlapped for smaller doorknob diameters. An elastic member held in place onto outwardly extending posts or prongs of each of the half cup-shaped members provides the elastic biasing grip around the doorknob to facilitate holding the device in place tightly against the doorknob and against the door itself to protect the doorknob from becoming paint spotted while still allowing full paint coverage of the door immediately adjacent the doorknob itself.

BRIEF SUMMARY OF THE INVENTION

This invention is directed to paint shield device for doorknobs of various sizes. The device includes two flexible clamshell shaped half cups mold formed together as a unit and connected together along a living hinge between the half cups. The half cups are pivotally movable together about the living hinge to mate or overlap each free distal side margin of each of the half cups to form a substantially complete cup having a substantially cylindrical side wall, a substantially closed bottom, and an open end adapted to admit a doorknob therein. A prong or post extends outwardly from an outer sidewall surface of each half-cup to receive an elastic connector stretchably attachable to each prong or post with the half cups in the closed position to produce sufficient biasing force to hold the device in position over the doorknob.

It is therefore an object of this invention to provide a doorknob paint shield which is easily attachable onto a circular doorknob and to be there retained during painting operations of the door and other room surfaces.

It is still another object of this invention to provide a doorknob paint shield which is readily adaptable to a broad range of circular sizes of doorknobs at the time of installation.

Yet another object of this invention is to provide a doorknob paint shield formed as a unit of thin-wall flexible plastic material and having a knockout forming a door handle clearance aperture adapted to receive a laterally extending elongated handle of a circular doorknob.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
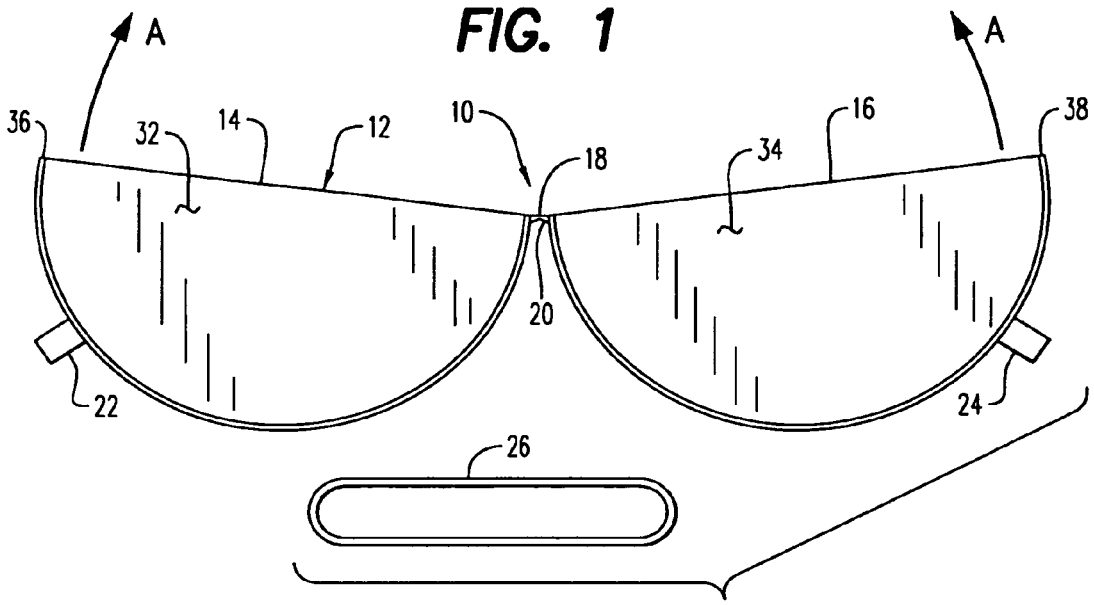
FIG. 1 is a top plan view of one embodiment of the invention in its open position.

Referring now to the drawings, and particularly to FIGS. 1, 3, 4, 5 and 8, one embodiment of the invention is there shown generally at numeral 10 and includes two flexible clamshell shaped half cups 14 and 16 molded together as a single unit shown generally at numeral 12. This single molded unit 12 is formed of injection molded plastic, preferably polyurethane, having a nominal wall thickness of the semi-cylindrical sidewalls and bottom halves 32 and 34 in the range of 0.04". The invention 10 also includes an elastic band 26 whose function will be described herebelow.

Each of the half cups 14 and 16 are connected together about a living hinge 18 having a thinned line of weakness 20 in the range of 0.005" thickness. Prongs or posts 22 and 24 outwardly extending from the outer surfaces of each of the half cups 14 and 16, respectively and are engageable as will be described herebelow by an elastic band 26 to secure the device 12 in position over a circular doorknob. These prongs 22 and 24 are equally spaced from the respective edges or margins 36 and 38.

Figure 4:
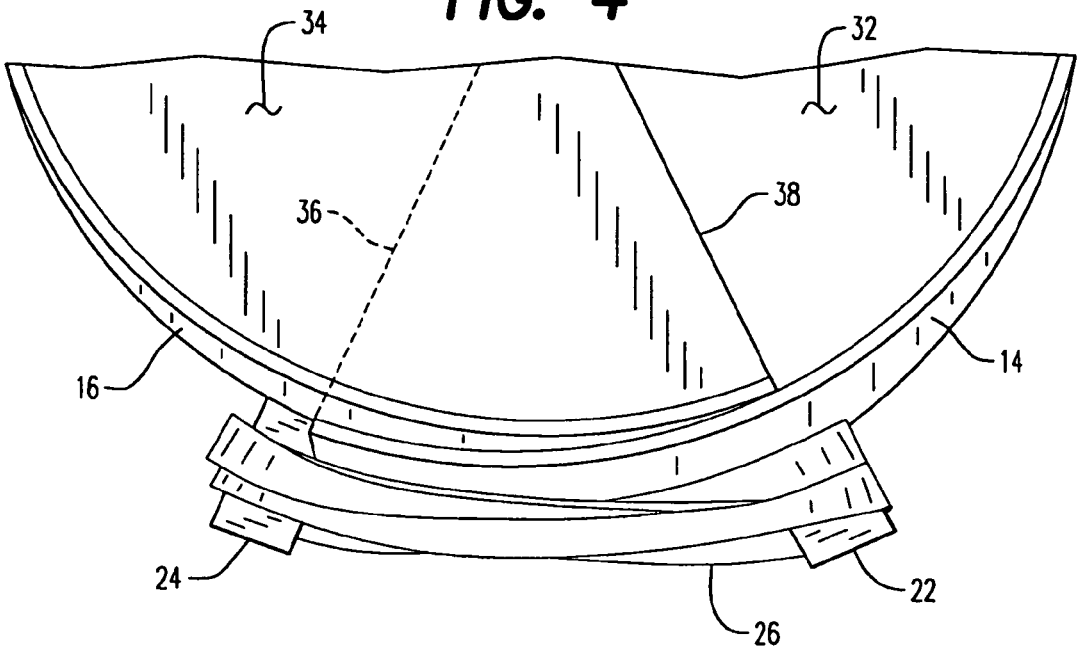
FIG. 4 is a top plan broken view of FIG. 3.
Figure 3:
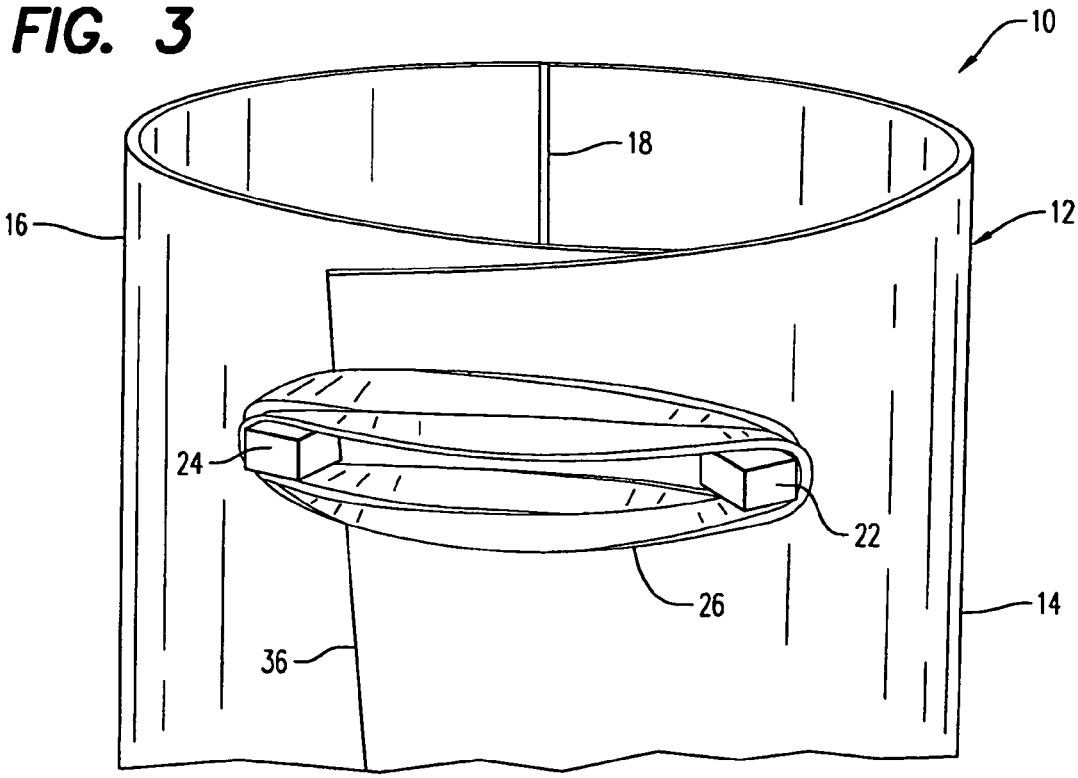
FIG. 3 is a perspective view of an upper portion of the invention of FIG. 1 in the assembled configuration.
Figure 5:
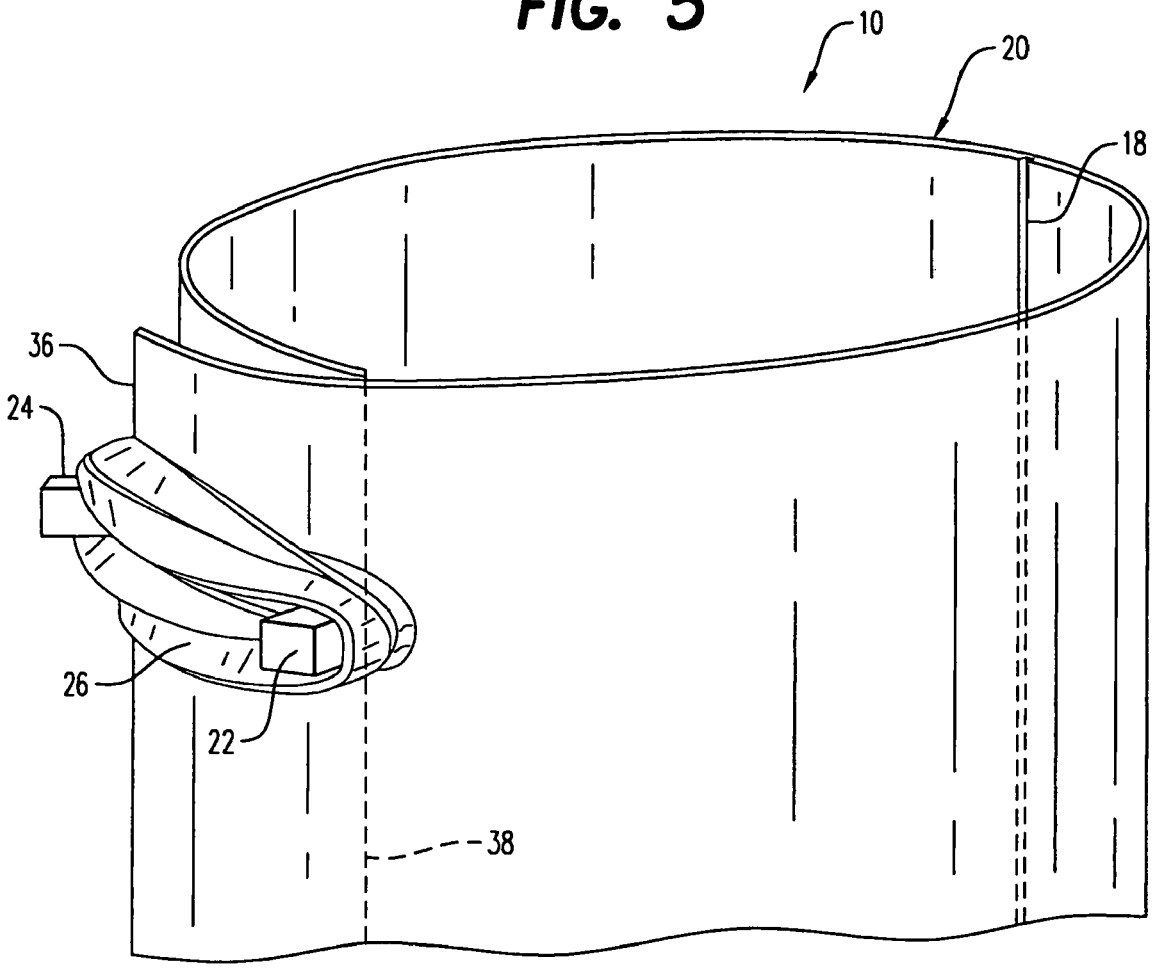
FIG. 5 is another perspective view of FIG. 3.
Figure 8:
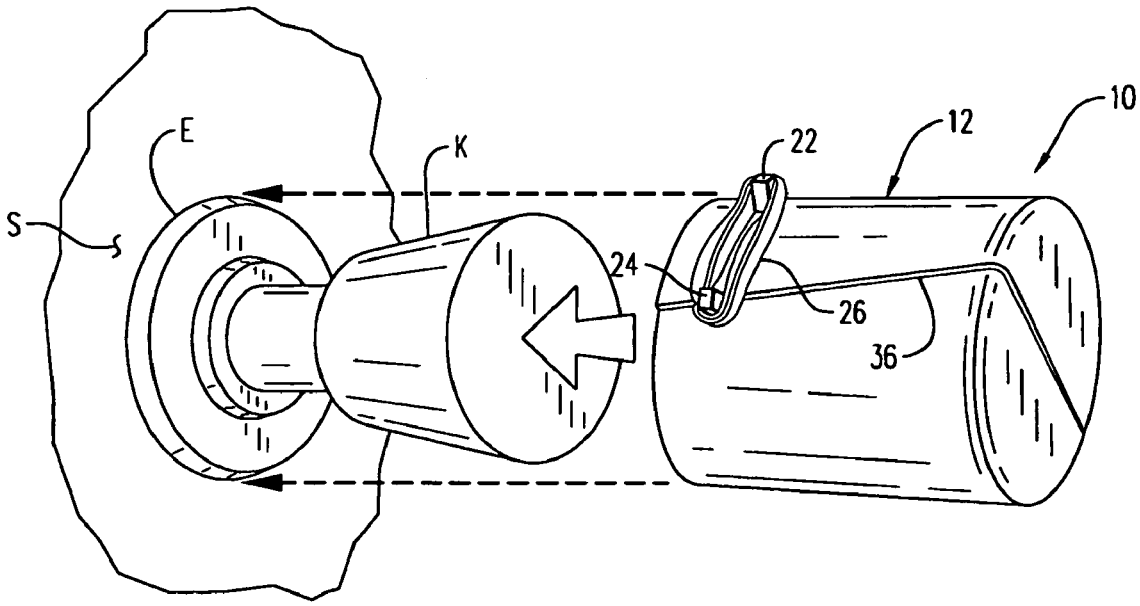
FIG. 8 is an exploded view of the embodiment of FIG. 1 being installed onto a circular doorknob.

As the half cups 14 and 16 are moved from the open position shown in FIG. 1 in the direction of arrows A to a closed position about the living hinge 18, the margins or edges 36 and 38 of each of the cups 14 and 16, respectively come in contact with one another to define a completed cup as best seen in FIG. 8. However, to be adaptable to a broad range of doorknob diameters, either of the base E or the handle K of the doorknob shown in FIG. 8, whichever is larger, the half cups 14 and 16 and their corresponding margins 36 and 38 may also overlap one another as facilitated by the thin resilient nature of the plastic material and the device itself. Thus, in the closed position, the bottom panels 32 and 34 along with the side walls of the half cups 14 and 16 themselves may overlap as best seen in FIGS. 3, 4 and 5.

This variable diameter adaptability of the completed cup in the closed position, again facilitates being suitably sizable around a broad range of doorknob diameters. To retain the mating inside diameter of the completed cup shown in FIGS. 3 to 5 and 8, the elastic band 26 is wrapped repeatedly as necessary around each of the prongs 22 and 24, as shown, to apply closing tension between the prongs and to thus create a biasing force exerted by the open end of the completed cup onto the circular base E of the doorknob K as seen in FIG. 8.

Figure 2:
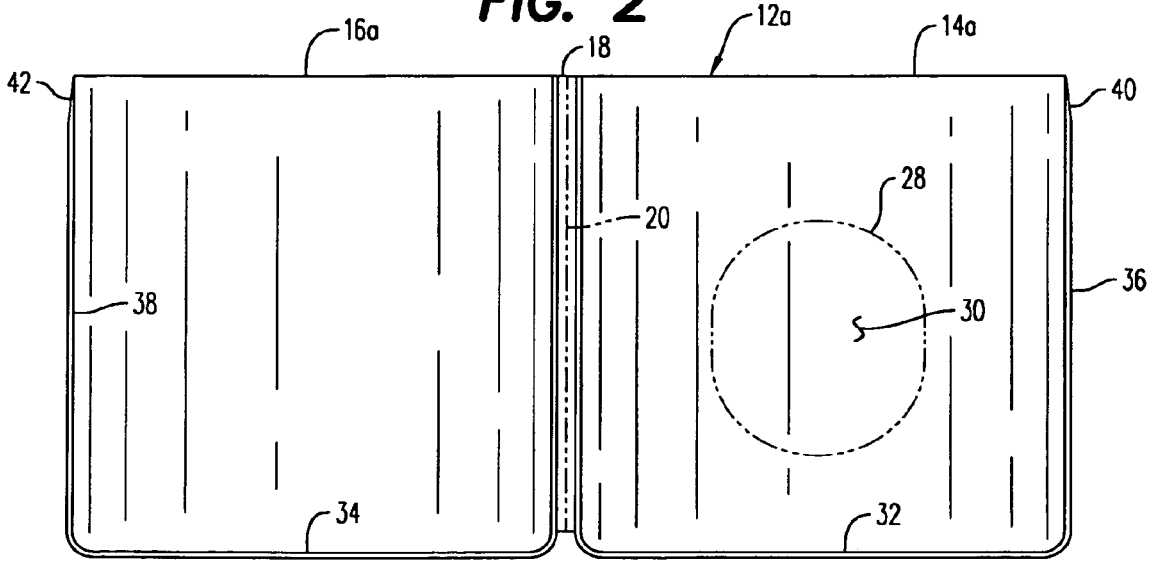
FIG. 2 is a front elevation view of a preferred embodiment of the invention.

Referring now to FIG. 2, another embodiment of the invention is there shown at 12*a* and includes half cups 14*a* and 16*a* as previously described. Again, each of the half cups 14*a* and 16*a* are formed as a unit and connected together by living hinge 18 and flexibly moveable from the open to the closed position about line of weakness 20 as previously described.

In this embodiment 12*a*, a tapered band portion 40 and 42 immediately adjacent the open ends of each of the half cups 14*a* and 16*a*, respectively, is provided. These tapered band portions 40 and 42 taper from the nominal wall thickness of approximately 0.04" down to a thickness of approximately 0.015" tapering inwardly from the outside surface. The purpose of these tapered band portions 40 and 42 is primarily to minimize coverage of the door surface S immediately adjacent to the base E of the doorknob K during painting. By thinning the edge margins 36 and 38 downwardly at the open end of the device 12*a* when in the closed position, absence of paint coverage is minimized. Moreover, heightened flexibility is also obtained in adapting to the various diameters of doorknobs sought to be protected from paint spattering by the device 12*a*.

Figure 6:
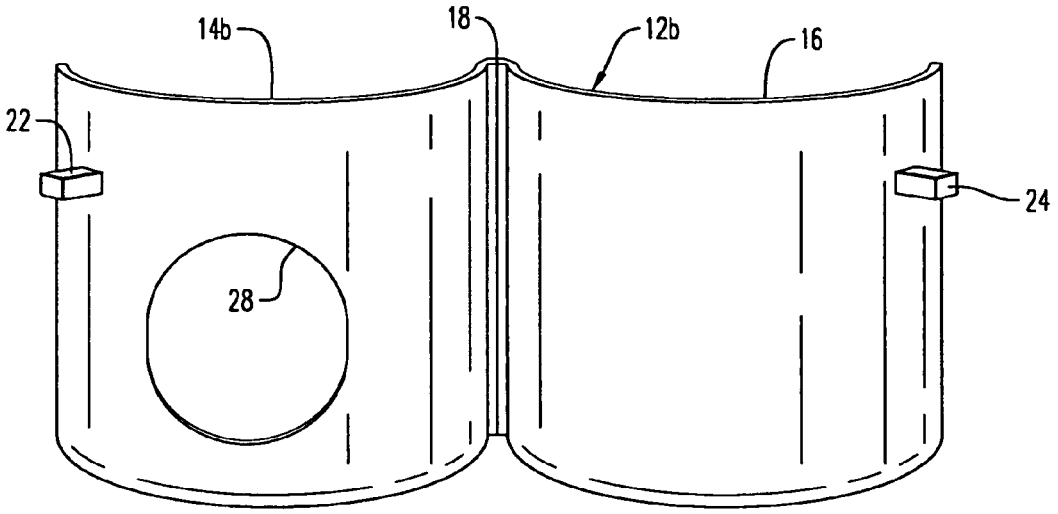
FIG. 6 is a perspective view of the invention of FIG. 1 in the open position showing the handle clearance knockout removed.
Figure 7:
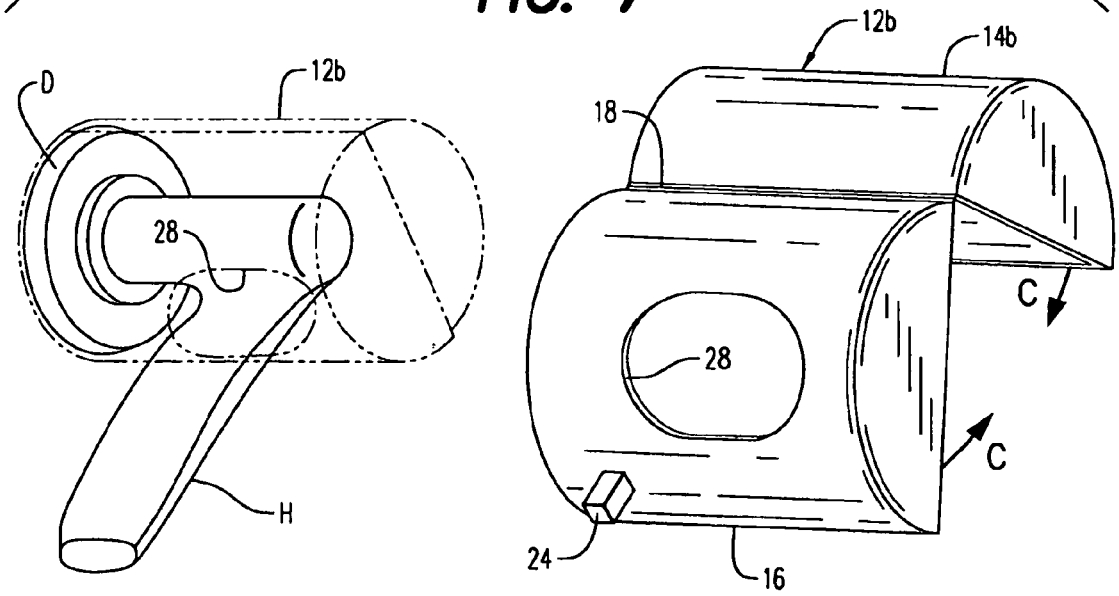
FIG. 7 is a perspective exploded view of the embodiment of FIG. 6 being installed over a straight handled doorknob.

Referring now to FIGS. 2, 6 and 7, embodiments 12*a* and 12*b* each also include the preferred feature of a knockout plug 30 which is formed by a continuous line of weakness 28 during the molding process. This knockout plug 30 may be left intact as seen in FIG. 2 where the doorknob is circular and cylindrical. However, as seen in FIGS. 6 and 7, the knockout plug 30 has been removed along the line of weakness 28 leaving a clearance aperture which is positionable over an elongated laterally extending handle H of doorknobs of this type. Once fitted into the position shown in phantom in FIG. 7, the device 12*b* may then be secured by the elastic band 26 into secure tight fit position over the doorknob base D to prevent paint or other surface coatings to be inadvertently dripped or otherwise disposed on the main portion of the doorknob. However, because the handle H extends outwardly from this clearance aperture formed by line of weakness 28, a masking or covering of the handle H would also be required to fully protect the surfaces of this doorknob variation.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A paint shield device for preventing paint from contaminating a doorknob comprising:

two flexible clam-shell shaped half cups mold formed together as a unit of a plastic material and connected together only along an elongated living hinge which extends along a longitudinal proximal side margin of each of said half cups;

each of said half cups pivotally moveable together from an open to a closed position about said living hinge to mate or overlap each free distal side margin of each of said half cups to form a substantially complete cup having a substantially cylindrical side wall, a substantially closed bottom, and an open end thereof adapted to admit a doorknob therein;

a prong extending outwardly from an outer sidewall surface of each of said half cups and in proximity to the corresponding said distal side margin, each said prong spaced from said open end a similar distance;

an elastic connector stretchably attachable to and between each said prong with said half cups in the closed position and a doorknob positioned within said open end, said connector producing sufficient biasing force between said open end and the doorknob to retain said device in position over the doorknob;

one said half cup including a substantially continuous line of weakness defining a knockout plug which, when removed, forms a clearance aperture adapted to provide clearance for an elongated laterally extending handle of the doorknob.

2. A paint shield device as set forth in claim 1, wherein:

each of said half cups includes a tapered band portion along said open end to minimize door surface coverage and to provide enhanced adaptive flexibility of said open end around doorknobs of different diameters.

* * * * *